US006116029A

United States Patent [19]

Krawec

[11] Patent Number: 6,116,029

[45] Date of Patent: Sep. 12, 2000

[54] ATMOSPHERIC CONTROL SYSTEM FOR A HUMIDOR

[76] Inventor: Victor Krawec, 7C Van Winkle St., Bloomfield, N.J. 07003

[21] Appl. No.: 09/267,505

[22] Filed: Mar. 12, 1999

[51] Int. Cl.[7] ..... F25B 21/02

[52] U.S. Cl. ..... 62/3.3; 62/3.4; 62/457.9

[58] Field of Search ..... 62/3.3, 3.4, 3.6, 62/457.9, 171

[56] References Cited

U.S. PATENT DOCUMENTS

| | | | |
|---|---|---|---|
| 5,367,879 | 11/1994 | Kraus et al. | 62/176.1 X |
| 5,400,612 | 3/1995 | Hedges | 62/171 |
| 5,456,164 | 10/1995 | Bang | 62/440 X |
| 5,556,579 | 9/1996 | Newman . | |
| 5,741,444 | 4/1998 | Kasuli | 261/128 |
| 5,842,597 | 12/1996 | Kraus et al. | 211/150 R |
| 5,971,205 | 10/1999 | Michaels et al. . | |

*Primary Examiner*—William Doerrler

*Assistant Examiner*—Chen-Wen Jiang

[57] ABSTRACT

An apparatus for storing cigars includes a housing having a storage compartment and an atmospheric control system for controlling the temperature and humidity within the storage compartment. The housing is preferably a humidor having a storage compartment access lid and a compartment for retaining at least part of the atmospheric control system within the storage compartment. A perforated Spanish cedar board elevated from the baseboard in the storage compartment permits the circulation of humidity and heat. The atmospheric control system includes a power supply, a microcontroller for controlling the system, a sensor for sensing the humidity and temperature within the humidor and sending temperature and humidity readings to the microcontroller, and a vaporizer for producing humidity and a thermoelectric module for cooling and heating. Optionally, a display for displaying temperature and humidity conditions in the humidor and a lid-open sensor for deactivating the atmospheric control system when the lid is open may be provided.

13 Claims, 6 Drawing Sheets

ATMOSPHERIC CONTROL SYSTEM FOR A HUMIDOR

BACKGROUND OF THE INVENTION

The present invention relates to the field of controlled atmospheric storage devices, and more specifically to humidors.

To preserve a cigar, the storage environment should permit no light to impinge on the cigar, the temperature should be controlled to approximately 69–72° F., and the relative humidity level should be 69%–73%. At this humidity range the tobacco is pliable and at optimal smokability. If the humidity falls below this range, the cigar dries and breaks apart. If the humidity rises above this range, the tobacco swells and it becomes difficult for the smoker to draw the smoke from the cigar. Further, at increased humidity, the cigar can lose its integrity. Current humidification systems for humidors are primitive in concept as well as their ability to consistently maintain an optimal humidity/temperature level for cigar preservation. Most humidification systems provide humidity to a storage compartment by positioning a sponge or an open-cell foam saturated with distilled water within the humidor to permit the air within the compartment to slowly absorb the moisture from the sponge into the air. This system works to some extent, but does not adequately maintain a constant humidity level when temperatures in the environment outside the storage compartment fluctuate. More recently, a chemical, propylene glycol has been added to the saturated sponge/foam to regulate the humidity level as close to 70% as possible. The chemical, however, has a significant drawback, as it has the effect of altering the natural taste of the tobacco.

Other examples of humidification systems for humidors include a reservoir of water and a fan which is positioned to create an air stream over the reservoir to provide humidity or a reservoir of water that is heated such that water evaporates to increase the humidity within the reservoir. Examples of such systems are described in U.S. Pat. Nos. 5,741,444 (Kasuli) and 5,400,612 (Hedges), the contents of which are incorporated by reference.

A system for controlling the environment of a vending machine for cigars, among other products, has been described in U.S. Pat. No. 5,842,597, which is also incorporated by reference. This system, however, includes components that are too large to be practically incorporated into a portable humidor.

It would therefore be advantageous to provide an apparatus and method that would overcome the above-identified shortcomings of the prior art.

SUMMARY OF THE INVENTION

An apparatus is provided for storing cigars, including a housing, a storage compartment for receiving cigars, and an atmospheric control system for controlling the temperature and humidity within the storage compartment.

The housing is preferably a humidor having a storage compartment access lid and a compartment for retaining at least part of the atmospheric control system. A perforated Spanish cedar board elevated from the baseboard in the storage compartment allows for the circulation of the humidity and temperature. The apparatus additionally includes a lid open sensor that shuts down the atmospheric control system when the lid of the housing is open. The humidor is preferably constructed of a hardwood bonded together to form a rectangular box. The interior walls of the humidor is preferably lined with Spanish cedar wood, which has moisture-absorbing properties and helps to age cigars.

The atmospheric control system utilizes a combination of components for maintaining humidity and temperature inside the humidor. The first circuit consists of the power supply, delivering power to the atmospheric control system. A programmed microcontroller, which controls the components of the atmospheric control system is powered by the first circuit. A humidity and temperature sensor, also powered by the first circuit, continuously send temperature and humidity readings to the programmed microcontroller. The component used for producing humidity, a vaporizer, for example, is powered by a second circuit. The vaporizer may be, by way of non-limiting example, a thermal vaporizer. A third circuit delivers power to a thermoelectric module, the component being used to generate cooling and heating effects. A fourth circuit delivers power to a display, which shows current temperature and humidity conditions within the humidor. A fifth circuit delivers power to a lid open sensor, which deactivates the atmospheric control system when the lid is open.

It is an object of the present invention to provide a humidor that controls both humidity and temperature at near-optimal levels for storing and preserving cigars.

It is another object of the present invention to provide a humidor sized to fit conveniently within a room of a dwelling house or an office.

It is also an object of the present invention to provide a humidor that is reliable, while being relatively inexpensive to manufacture and maintain.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

It is to be understood that the embodiments described below are exemplary of the invention and may be embodied in various forms. Specific functional and structural details are a basis for instructing one skilled in the art to employ this invention in any appropriately detailed structure.

Figure 1:
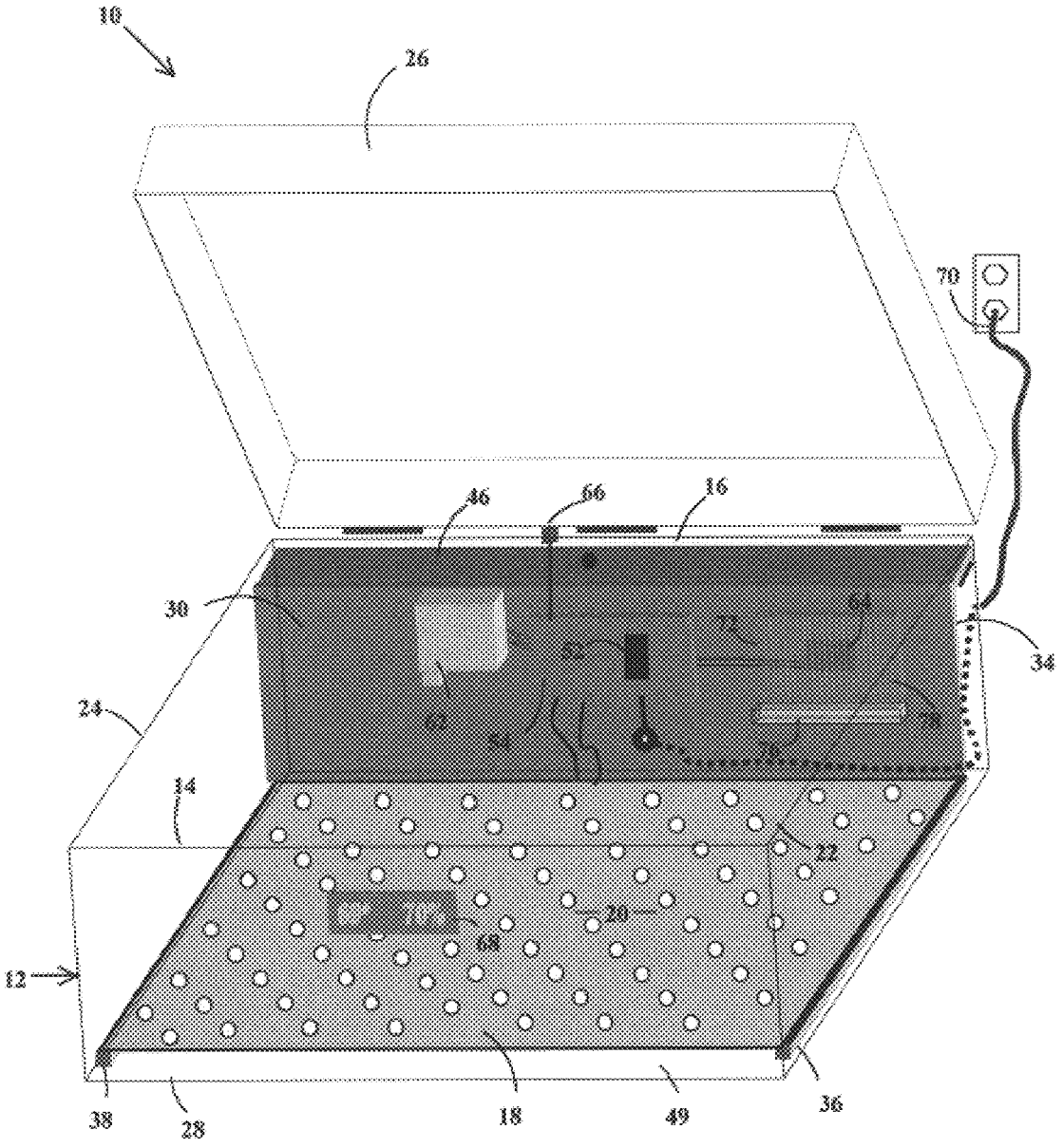
FIG. 1 is a perspective view of the humidor constructed in accordance with the invention having the access lid in the open position.
Figure 2:
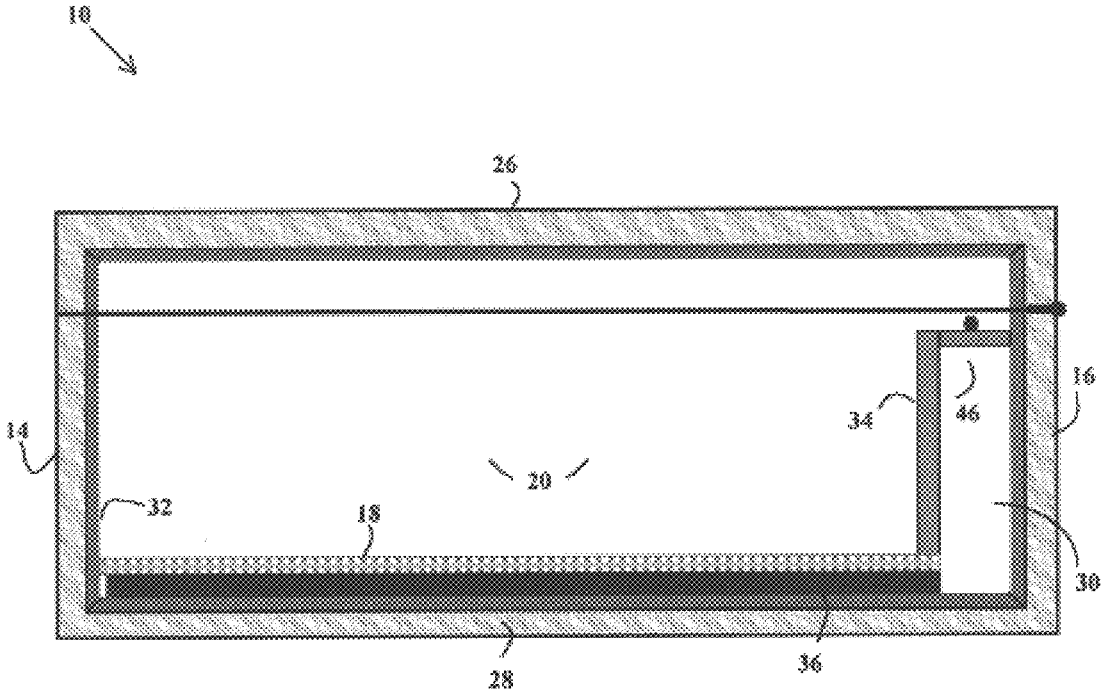
FIG. 2 is a cross-sectional side view of the humidor of FIG. 1.
Figure 3:
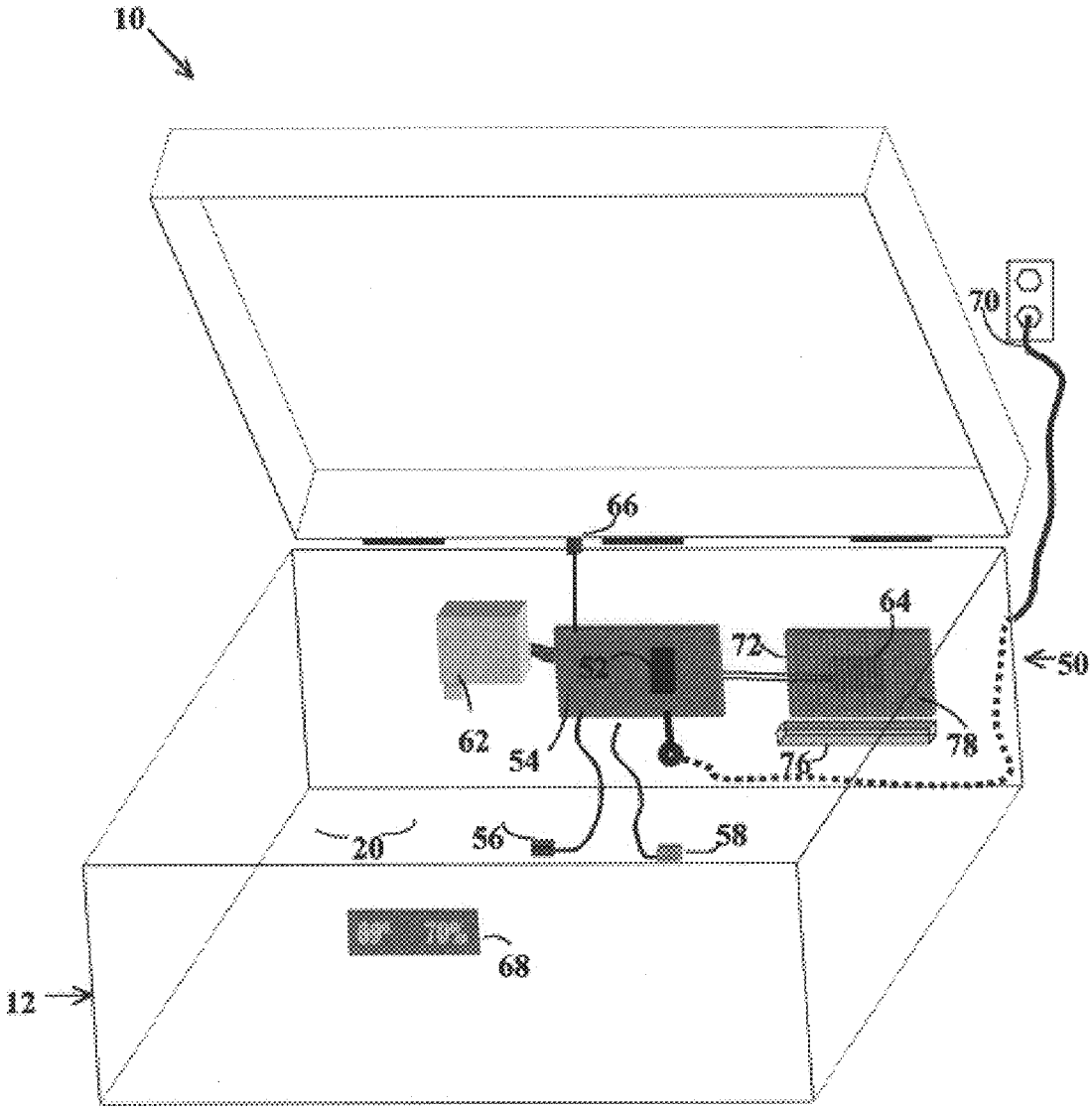
FIG. 3 is a perspective view of the humidor constructed in accordance with the invention.

Referring to FIGS. 1, 2 and 3, a humidor 10 is shown which includes a housing 12 containing a storage compartment 20 for retaining cigars. Housing 12 also includes an apparatus compartment 30 for retaining certain components of the atmospheric control system 50. Housing 12 is preferably a rectangular box-like structure having a front wall 14, a rear wall 16, two side walls 22 and 24, a top wall 26 and a bottom wall 28. Top wall 26 is hinged to function as the primary access lid. Housing 12 is preferably constructed of hard wood and the interior is preferably lined with a lining 32, preferably Spanish cedar (FIG. 2). Lining 32 is preferably bonded to front wall 14, rear wall 16, side walls 22, 24, top wall 26 and bottom wall 28 by a waterproof glue, although any appropriate bonding mechanism may be used.

Referring to FIGS. 1 and 2, in a preferred embodiment, storage compartment 20 includes a perforated board 18 positioned above bottom wall 28 and cedar portions 36, 38 disposed between perforated board 18 and lining 32. Cedar portions 36,38 serve to support perforated board 18 and space perforated board 18 from bottom wall 28.

Apparatus compartment 30 is formed by rear wall 16, side walls 24 and 22, bottom wall 28, a partition 34, and a cover 46. Preferably, cover 46 is removable to allow access to apparatus compartment 30 and consists of Spanish cedar. Partition 34 preferably consists of Spanish cedar, is supported by the top surface of perforated board 18 (which in turn rests on cedar portion 36,38), and is substantially perpendicular to walls 22 and 24. Referring to FIG. 1, a gap 49 is formed below partition 34 and between perforated board 18 and bottom wall 28 and extends from front wall 14 to rear wall 16. Gap 49 is in fluid communication with apparatus compartment 30 and permits cooled or heated air and humidity created in apparatus compartment 30 to circulate from apparatus compartment 30 into gap 49 and then via perforated board 18 into storage compartment 20. In an alternative embodiment, a fan (not shown) can be positioned within apparatus compartment 30 to assist in circulating cooled or heated air and humidity produced by atmospheric control system 50.

Figure 4:
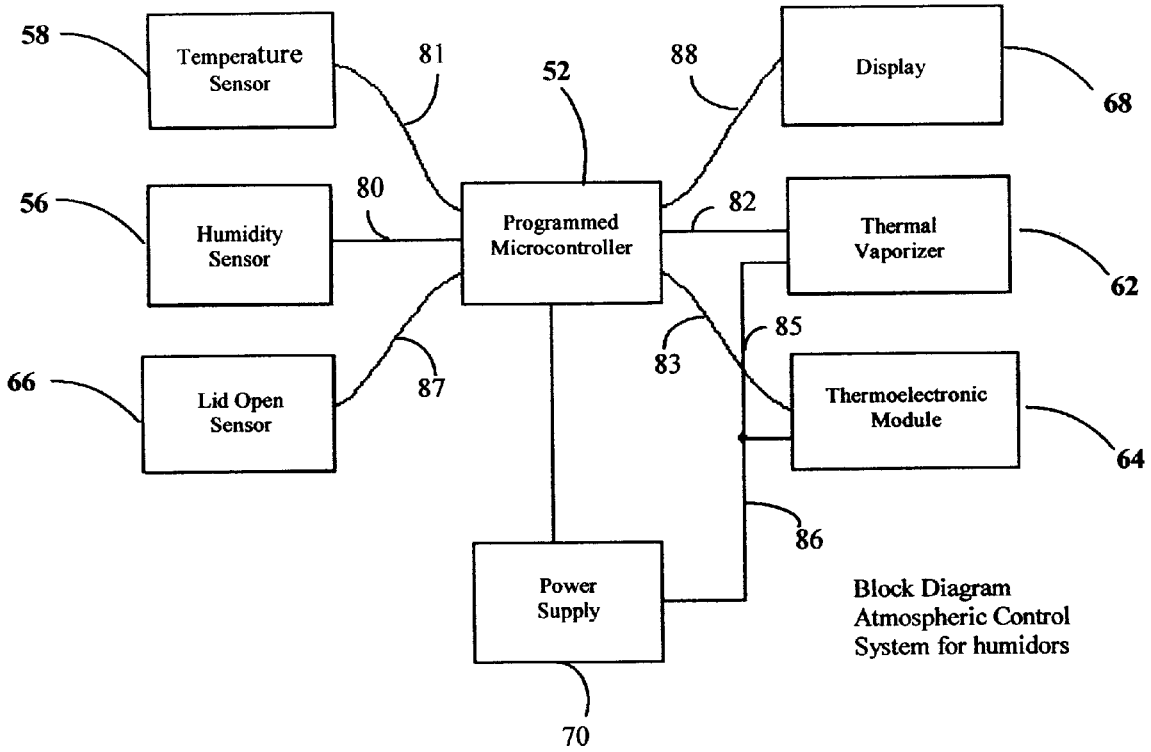
FIG. 4 is a block diagram of the humidor constructed in accordance with the invention.

Referring to FIGS. 3 and 4, the components of atmospheric control system 50 in a preferred embodiment and in schematic form are shown, respectively. Atmospheric control system 50 includes a power supply 70, a circuit board 54, a humidity sensor 56, a temperature sensor 58, a vaporizer 62, a thermoelectric module 64, a drip-trap 76 and heat sinks 72, 74. See FIGS. 5 and 6.

Vaporizer 62 is secured to rear wall 16 and coupled to microcontroller 52 of circuit board 54. Vaporizer 62 is powered by power supply 70 through line 85 and receives a vaporizer signal 82 from microcontroller 52 to produce humidity when the humidity level in compartment 20 falls below a predetermined level. In one embodiment, vaporizer 62 may be fashioned similarly to cartridges used to supply ink in bubble jet printers (e.g., Hewlett Packard, Canon, Lexmark). In such a case, the cartridge would eject, for example, vaporized distilled water measured in picoliters (rather than ink) into storage compartment 20. A fan (not shown) may be mounted within the compartment to assist in circulation of the humidified air created when the vaporized water is ejected from vaporizer 62. It is understood that any art-known humidifier or vaporizer may be used in combination with other elements described herein, examples of which are described in U.S. Pat. Nos. 5,741,444 and 5,400,612. For example, vaporizer 62 may be, by way of non-limiting example, a thermal vaporizer.

Figure 5:
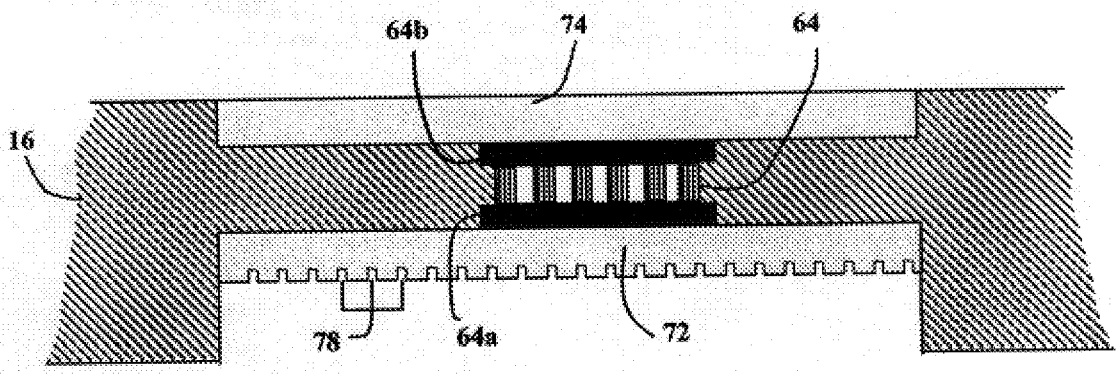
FIG. 5 is a cross-sectional view of the thermoelectric module.

Thermoelectric module 64, which is also known in the art as a Peltier chip or thermal cooler, produces cooling or heating effects by pumping heat out of the box or pumping heat into the box. Referring to FIG. 5, thermoelectric module 64 is coupled to microcontroller 52 and includes inner surface 64*a* and outer surface 64*b* and is preferably embedded in rear wall 16 of apparatus compartment 30. Thermoelectric module 64 is powered by power supply 70 through line 86 and receives a signal 83 from microcontroller 52 to pump heat into humidor 10 when the temperature within storage compartment 20 falls below a predetermined level. Conversely, if the temperature rises above the predetermined level in storage compartment 20, microcontroller 52 transmits a signal 83 to thermoelectric module 64 to pump heat out of humidor 10. The type of thermoelectric module 64 will vary with the interior dimensions and composition of humidor 10. Where humidor 10 is made from ¾" hardwood lined with ¼" Spanish cedar and the internal dimensions are 10"×6½"×5", thermoelectric module 64 may be a Tellurex CZ1-1.4-127-1.65.

Referring to FIGS. 3 and 5, heat sinks 72 and 74 are secured to inner surface 64*a* and outer surface 64*b* of thermoelectric module 64, respectively with a thermal epoxy. Heat sinks 72 and 74 preferably consist of a metal with good thermal conductivity properties, such as brass or copper. Heat sink 72 preferably includes channels 78, which may be milled such that channels 78 extend substantially in the vertical direction relative to bottom wall 28. (See FIGS. 5 and 6). Heat sink 72 is exposed to the interior of apparatus compartment 30 and heat sink 74 is exposed to the exterior of humidor 10. Heat sink 74 discharges unwanted heat by means of natural convection. Thermoelectric module 64 pumps heat from heat sink 72 through to heat sink 74. A fan (not shown) may be added to heat sink 74 to provide forced convection to decrease the time required to reduce the temperature within humidor 10.

Circuit board 54 is disposed within apparatus compartment 30 and is secured to rear wall 16. Circuit board 54 includes a microcontroller 52 programmed to control the components of the atmospheric control device, and is powered by power supply 70. In a preferred embodiment, microcontroller 52 is a Motorola part number M68HC11E9. Alternatively, any general purpose microcontroller having at least two A/D channels, and eight I/O pins may be substituted. Power supply 70 powers circuit board 54, and its associated components, microcontroller 52, thermoelectric module 64, and vaporizer 62. Power supply 70 preferably converts 120 V AC to a DC voltage source by employing a transformer.

Microcontroller 52 receives a humidity signal 80 from humidity sensor 56 and a temperature signal 81 from temperature sensor 58, each of which are preferably secured to bottom wall 28 and spaced apart from vaporizer 62 and heat sink 72. Preferably humidity sensor 56 and temperature sensor 58 are positioned at a location in fluid communication with storage compartment 20. For example, as is shown in FIG. 3, humidity sensor 56 and temperature sensor 58 can be positioned below perforated board 18 and attached to lining 32. Humidity sensor 56 is preferably a Farnell #540-985. Humidity sensor 56 senses changes in humidity within storage compartment 20 and changes resistance with respect to humidity. Alternatively, any humidity sensor that varies capacitance with respect to humidity can be used. Temperature sensor 58 is preferably a National Semiconductor LM50CIM3 single-supply temperature sensor. Alternatively, a thermistor or any other temperature sensor known to those skilled in the art may be used.

Microcontroller 52 compares humidity signal 80 with a predetermined relative humidity range and transmits a humidification signal to vaporizer 62. As discussed above, the relative humidity range is preferably 69%–73%. When the humidity level falls below the lower limit of the humidity range, vaporizer 62 produces humidity, which is permitted to circulate throughout the storage compartment, until the humidity signal 80 falls within the predetermined humidity range. Conversely, when the sensed humidity is higher than the predetermined humidity range, microcontroller 52 transmits a signal 83 to thermoelectric module 64 to cool the temperature as is described above.

Figure 6:
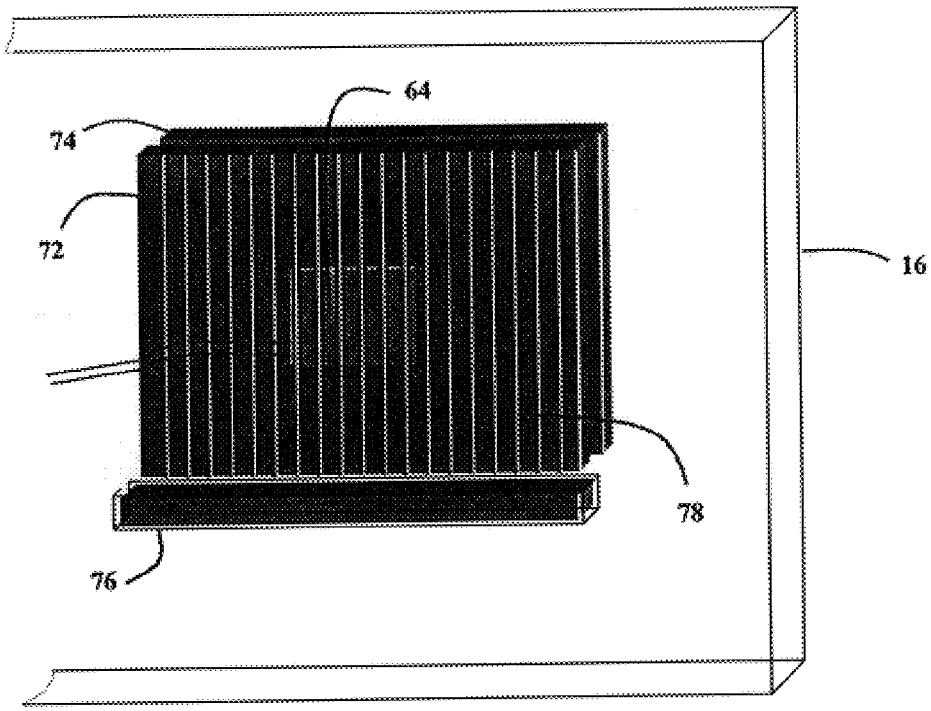
FIG. 6 is a perspective view of the dehumidification elements in accordance with the invention.

When the temperature reaches the dew point associated with the sensed humidity level, excess humidity condenses as water droplets on heat sink 72. The water droplets run down channels 78 and onto drip-trap 76, which is positioned directly under heat sink 72 (FIG. 6). Drip-trap 76 is preferably made of a super-absorbent paper manufactured by Desiccare, Inc. However, any absorbent material or container may be used to collect the excess condensed humidity, such as a desiccant. In an alternative embodiment, a pump and silicon tubing may be connected to a drip-trap container (not shown) and re-circulated to the vaporizer for use in the humidifying process at a later time.

Microcontroller 52 also compares the temperature signal with a predetermined temperature range and transmits signal 83 to thermoelectric module 64 to reduce the temperature when the temperature is greater than an upper temperature limit, preferably 73° F., and transmits signal 83 to thermoelectric module 64 to increase the temperature when the temperature is less than a lower temperature limit, preferably 69° F. As is discussed above, when the sensed temperature within storage compartment 20 falls below a predetermined level, thermoelectric module 64 receives signal 83 from microcontroller 52 to pump heat into humidor 10. Conversely, if the temperature within storage compartment 20 rises above the predetermined level in storage compartment 20, microcontroller 52 transmits a signal 83 to thermoelectric module 64 to pump heat out of humidor 10.

Referring to FIG. 1 and 3, atmospheric control system 50 may include a lid-open sensor 66. Sensor 66 is secured to rear wall 16 at a location where rear wall 16 meets top wall 26. Sensor 66 is coupled to the programmed microcontroller 52 through lid-open signal 87 and deactivates atmospheric control system 50 when the lid is opened. Lid-open sensor 66 is preferably a Hamlin magnetic reed switch, model number MDSR-7 10-20, but may be any switch known in the art.

Atmospheric control system 50 may include a display 68, which is coupled to programmed microcontroller 52 by line 88, and displays the temperature and humidity levels inside storage compartment 20. The display is preferably an LED display with 4-digit capability, embedded in front wall 14 such that display 68 is readable on the outside surface of front wall 14. Display 68 can be an LCD, a florescent vacuum, or an analog display, for example.

As will be readily recognized by the person of skill in the art utilizing the teachings herein, the various shapes and dimensions described herein are exemplary and may be readily modified and adapted to suit a wide variety of sizes and shapes. Thus, a wide variety of shapes are contemplated and readily realized, making humidor 10 particularly suited to mass production, as well as customization. In particular, the components of the aforementioned preferred embodiment are particularly well-suited for a portable humidor. Nonetheless, the specific dimensions by which any particular application is satisfied are a matter of application-specific design choice.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A humidor, comprising:

a housing; and an atmospheric control system including:

a heat sensor disposed within the housing for sensing the temperature within the housing and transmitting a temperature signal;

a humidity sensor disposed within the housing for sensing the humidity within the housing and transmitting a humidity signal;

a vaporizer disposed within the housing for producing humidity within the housing when the humidity signal is lower than a predetermined humidity range; and a thermoelectric module for cooling and heating the housing when the temperature signal falls outside a predetermined temperature range.

2. The humidor of claim 1, wherein the housing includes a storage compartment for storing cigars and an apparatus compartment.

3. The humidor of claim 1, comprising a microcontroller for comparing the temperature signal with a predetermined temperature range and the humidity signal with a predetermined humidity range, and transmitting a heat signal to the thermoelectric module and a humidity signal to the vaporizer.

4. An atmospheric control system for a humidor, comprising:

a housing;

a humidity sensor disposed within the housing for sensing the humidity within the housing and transmitting a humidity signal; and a vaporizer disposed within the housing for automatically producing humidity within the housing when the humidity signal is lower than a predetermined range.

5. An atmospheric control system for a humidor, comprising:

a housing;

a heat sensor disposed within the housing for sensing the temperature within the housing;

a thermoelectric module for cooling and heating the atmosphere within the housing when the temperature falls outside a predetermined temperature range; and a humidity control means for automatically producing humidity within the housing when the humidity is lower than a predetermined range.

6. The atmospheric control system for a humidor of claim 5, comprising:

a humidity sensor disposed within the housing for sensing the humidity within the housing; and a vaporizer disposed within the housing for producing humidity within the housing when the humidity signal is lower than a predetermined humidity range.

7. The atmospheric control system for a humidor of claim 6, comprising a microcontroller for regulating the temperature within the humidor, said microcontroller connected to the heat sensor for receiving the temperature signal and connected to the thermoelectric module for transmitting a heat signal to the thermoelectric module when the temperature signal falls outside a predetermined temperature range.

8. The atmospheric control system for a humidor of claim 6, wherein the microcontroller comprises a comparator for comparing the temperature signal with a predetermined temperature range.

9. The atmospheric control system for a humidor of claim 6, comprising a microcontroller for regulating the humidity within the humidor, said microcontroller connected to the humidity sensor for receiving the humidity signal and connected to the vaporizer for transmitting a humidification signal to the vaporizer when the humidity signal falls outside a predetermined humidity range.

10. The atmospheric control system for a humidor of claim 9, wherein the microcontroller comprises a comparator for comparing the humidity signal with a predetermined humidity range.

11. A method of controlling the atmospheric conditions within a humidor, comprising the steps of:

sensing the humidity within a cigar storage compartment;

transmitting a humidity signal to a microcontroller;

comparing the humidity signal with a predetermined humidity range;

vaporizing a fluid within the storage compartment if the humidity signal is less than the humidity range; and decreasing the temperature within the storage compartment to a specified dew point temperature thereby condensing the excess humidity when the humidity signal is greater than the humidity range.

12. The method of 11, comprising the step of increasing the humidity within the storage compartment by ejecting a fluid into the storage compartment when the humidity signal is less than the humidity range.

13. A method of controlling the atmospheric conditions within a humidor, comprising the steps of:

sensing the humidity within a cigar storage compartment;

transmitting a humidity signal to a microcontroller;

comparing the humidity signal with a predetermined humidity range;

vaporizing a fluid within the storage compartment if the humidity signal is less than the humidity range;

sensing the temperature within the cigar storage compartment;

transmitting a temperature signal to the microcontroller;

comparing the temperature signal with a predetermined temperature range;

if the temperature signal is outside the temperature range, transmitting a second signal from the microcontroller to a thermoelectric module; and cooling or heating the storage compartment by pumping heat out of the storage compartment or pumping heat into the storage compartment with the thermoelectric module.

* * * * *